United States Patent [19]

Hogan

[11] Patent Number: 4,944,075

[45] Date of Patent: Jul. 31, 1990

[54] DETRIMENTAL-SUBSTANCE-CONTAINING THEFT-DETERRENT DEVICE

[75] Inventor: Dennis L. Hogan, St. Petersburg, Fla.

[73] Assignee: Security Tag Systems, Inc., St. Petersburg, Fla.

[21] Appl. No.: 408,618

[22] Filed: Sep. 18, 1989

[51] Int. Cl.[5] ..... A44B 9/00

[52] U.S. Cl. ..... 24/704.1; 70/57.1

[58] Field of Search ..... 116/203, 212; 34/572; 70/57.1; 24/704.1, 704.2, 707.1, 706.8

[56] References Cited

U.S. PATENT DOCUMENTS 4,483,049 11/1984 Gustavsson et al. .
4,590,461 5/1986 Cooper .
4,649,397 3/1987 Heaton et al. .
4,670,950 6/1987 Wisecup et al. .

*Primary Examiner*—James R. Brittain
*Attorney, Agent, or Firm*—Edward W. Callan

[57] ABSTRACT

A device for deterring theft of a protected article, including a pin and clutch for attaching the device to the article, with the pin and clutch being embodied in two components that are adapted to be locked together on opposite sides of a portion of the protected article to prevent unauthorized removal of the device from the article. The pin has a head that is anchored within one component; and the clutch in the other component grasps the pin to provide a predetermined retaining force for resisting separation of the components by prying or pulling the components apart. The one component includes three fragile elongated vials that fracture when at least a predetermined pressure is applied thereto, with each vial containing a detrimental substance that would damage the article if the vial were to be fractured while the device was attached to the article; and the one component defines a head space for enabling limited axial movement of the pinhead and three guide channels respectively containing three balls between the pinhead and the vials. Flexible cradles shield the vials from contact with the balls during a relaxed state, but yield to enable the balls to contact the vials when the balls are moved in response to the pinhead being moved in response to application to the two components of at least said predetermined threshold separation force.

13 Claims, 3 Drawing Sheets

FIG. 2
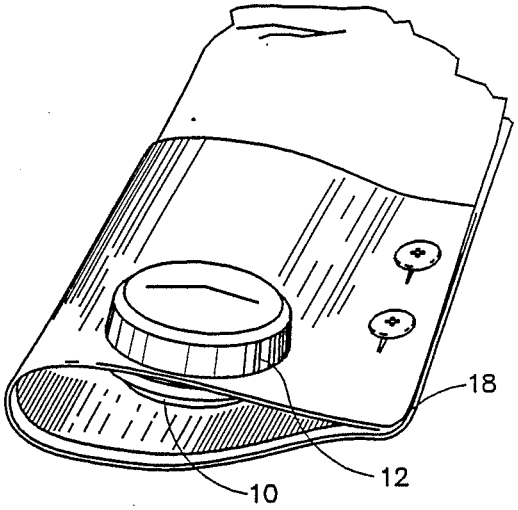
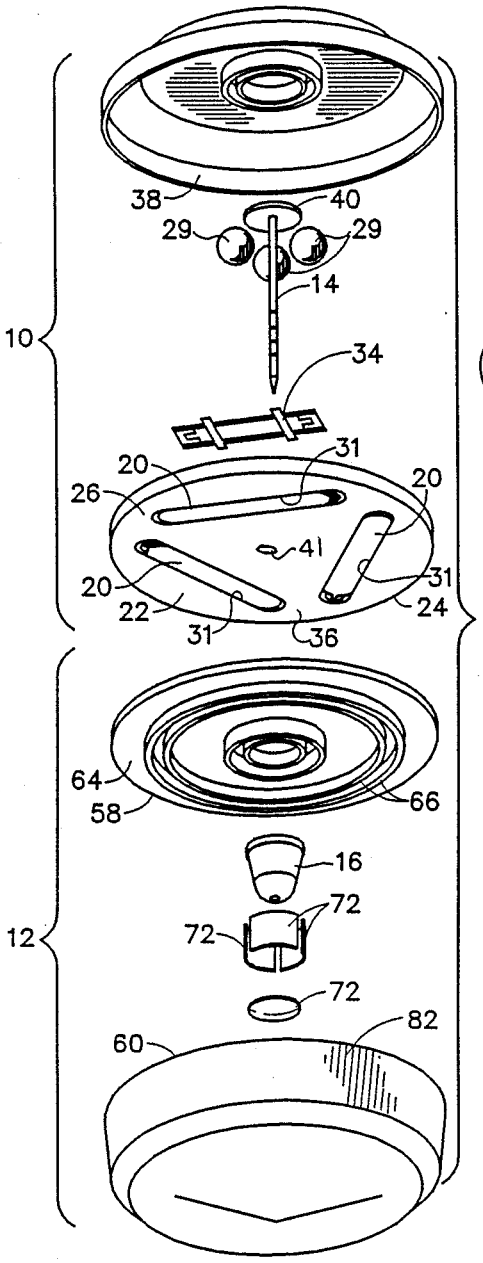
FIG. 1
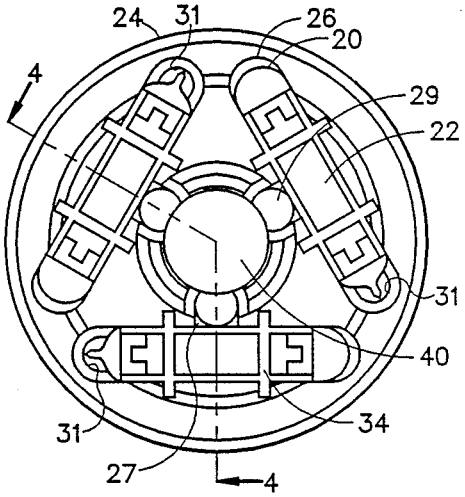
FIG. 3

FIG. 4C
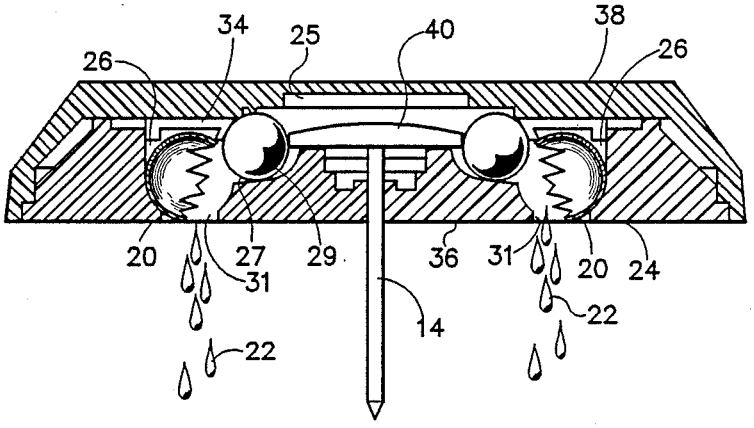
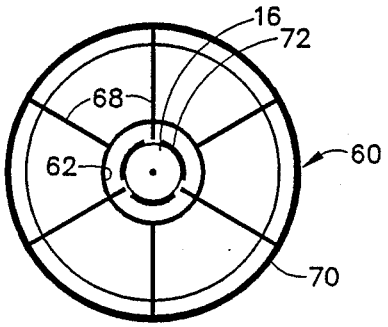
FIG. 5
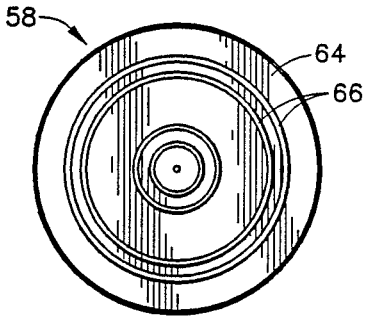
FIG. 6

DETRIMENTAL-SUBSTANCE-CONTAINING THEFT-DETERRENT DEVICE

BACKGROUND OF THE INVENTION

The present invention is generally directed to devices that may be attached to articles, such as merchandise, for deterring the theft of such articles, and is particularly directed to improvements in a theft-deterrent device of the type that contains a detrimental substance that damages a protected article attached to the device by releasing such substance when the device is tampered with during an unauthorized attempt to remove the device from the article.

Typically, the device includes means for attaching the device to the article, with the attaching means being embodied in two components that are adapted to be locked together on opposite sides of a portion of said article to prevent unauthorized removal of the device from the article. A typical attaching means includes a pin embodied in one of the two components and means embodied in the other component for receiving the pin. The device is attached to the protected article by passing the pin through a portion of the article. At least one of the two components includes a fragile elongated vial that fractures when flexed longitudinally, with said vial containing the detrimental substance that would damage the article if the vial were to be fractured while the device was attached to the article.

Prior art devices of this nature are described in U.S. Pat. Nos. 4,483,049 to Gustavsson et al., 4,670,950 to Wisecup et al. and 4,649,397 to Heaton et al. Typically, these devices are used to discourage the theft of such articles of merchandise as clothing, and the detrimental substance typically is an ink or dye or foul-smelling substance that permanently stains and or fouls the clothing so as to make the clothing unattractive and thereby generally unfit for wear.

In both the device described in U.S. Pat. No. 4,483,049 and the device described in U.S. Pat. No. 4,670,950, a detrimental substance is contained in two frangible vials that are respectively disposed in two opposing components that are secured together on opposite sides of a portion of the protected article when the device is locked to the article.

In the device described in U.S. Pat. No. 4,483,049, the vials fracture when severely contacted by a tool, such as a screw driver, that typically would be used in an attempt to pry apart the opposing components of the device so that the device could be removed from the protected article. The vials are so disposed in the device as to be readily contacted by a tool being used to pry apart the object and thereby fracture to release the detrimental substance onto an protected article locked to the device.

In the device described in U.S. Pat. No. 4,670,950, the frangible vials are longitudinally disposed in the two opposing elongated components so that when either component is flexed longitudinally during an attempt to pry the two components apart, the vial contained therein fractures to release the detrimental substance onto an protected article locked to the device.

In the device described in U.S. Pat. No. 4,649,397, two frangible vials are longitudinally disposed in one of two opposing elongated components so that when such component is flexed longitudinally during an attempt to pry the two components apart, the vials contained therein fracture to release the detrimental substance onto an protected article locked to the device. Such device further contains an electronic article surveillance tag of the type described in U.S. Pat. No. 4,481,428 to Lincoln H. Charlot, Jr.

SUMMARY OF THE INVENTION

The present invention provides a detrimental-substance-containing theft-deterrent device having a vial that will fracture to release the detrimental substance whenever a forceful attempt is made to detach the theft-deterrent device from the article to be protected, but which will not fracture under normal handling of the device.

The theft-deterrent device of the present invention includes means for attaching the device to a article to be protected, with said attaching means being embodied in two components that are adapted to be locked together on opposite sides of a portion of said article to prevent unauthorized removal of the device from the article; with the attaching means including a pin having a head that is anchored within one component and a clutch contained in the other component for grasping the pin to provide a predetermined retaining force for resisting separation of the components by prying or pulling the components apart; wherein said one component includes at least one fragile elongated vial that fractures when at least a predetermined pressure is applied thereto, with said vial containing a detrimental substance that would damage the article if the vial were to be fractured while the device was attached to the article; and wherein said one component defines a head space for enabling limited axial movement of the pinhead, and a guide channel for containing a movable object between the pinhead and the vial; and a movable object, such as a ball, disposed in said guide channel, with said movable object exerting little or no pressure between the vial and the pinhead while the attaching means is in a relaxed state, which occurs when no force is being applied to separate the two components; wherein the guide channel is contoured for enabling the pinhead to force the movable object to move and apply more than said predetermined pressure against the vial in response to the pinhead being moved in response to application to the two components of at least a predetermined threshold separation force that is nevertheless less than that required to overcome said predetermined retaining force, to thereby fracture the vial to release the substance contained therein before the components are separated by prying or pulling the components apart.

Preferably there are a plurality of said vials and a corresponding number of said guide channels and movable objects symmetrically disposed in relation to said pinhead so that the pinhead is equally supported by each of the movable objects when the pinhead is being moved in response to application to the two components of a separation force, to thereby prevent the pinhead from slipping around one of said movable objects.

It is also preferable that the device contain flexible cradles for shielding the vials from contact with the movable objects during said relaxed state, but which yield to enable the movable objects to contact the vials when the movable objects are moved in response to the pinhead being moved in response to application to the two components of at least said predetermined threshold separation force.

Additional features of the present invention are described in relation to the description of the preferred embodiment.

BRIEF DESCRIPTION OF THE DRAWING

FIG. 1 is an exploded perspective view of a preferred embodiment of the theft-deterrent device of the present invention.

FIG. 2 illustrates the attachment of the theft-deterrent device of FIG. 1 to a protected article or clothing.

FIG. 3 is a top plan view of a member of the one component of the theft-deterrent device of FIG. 1 that contains the vials and the movable objects, and anchors the pin.

FIGS. 4A, 4B and 4C are sector sectional views of the one component of the theft-deterrent device of FIG. 1 that contains the vials and the movable objects, taken along lines 4—4 in FIG. 3, showing a sequence of operation as the movable objects therein move to fracture the vials in response to the pin being forced downward.

FIG. 5 is a top plan view of the barrel of the second component of the theft-deterrent device of FIG. 1.

FIG. 6 is a bottom plan view of the cover of the second component of the theft-deterrent device of FIG. 1.

DESCRIPTION OF THE PREFERRED EMBODIMENT

Figure 4A:
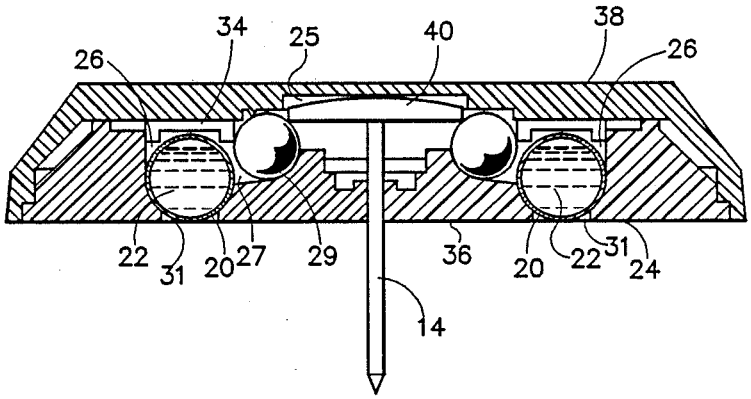

Referring to FIG. 1, a preferred embodiment of the theft-deterrent device of the present invention includes a first component 10 and a second component 12. The first component 10 includes a pin 14, and the second component 12 includes a clutch 16 for grasping the pin 14. The pin 14 is centrally located in the first component 10; and the clutch 16 is centrally located in the second component 16. The theft-deterrent device is attached to an article 18 to be protected (as illustrated in FIG. 2) by passing the pin 14 through a portion of the protected article 18 and engaging the pin 14 in the clutch 16 so that the clutch 16 grasps the pin 14. While the pin 16 is grasping the pin 14, the first component 10 and the second component 12 are locked together on opposite sides of a portion of the protected article 18 and thereby prevent unauthorized removal of the theft-deterrent device from the protected article 18. The pin 14 has a head 40 that is anchored within the first component 10; and the clutch 16 in the second component 12 grasps the pin 14 to provide a predetermined retaining force, such as 100 pounds (25 newtons), for resisting separation of the components 10, 12 by prying or pulling the components apart. The predetermined retaining force must be much greater than the separation force that would be applied in attempting to separate the two components 10, 12 by using one's bare hands.

The pin 14, the clutch 16 and the technique of releasing the pin 14 from the grasp of the clutch 16 so that the first component 10 can be unlocked from the second component 12 to thereby detach the protected article 18 from the theft-deterrent device are described in U.S. Pat. No. 4,523,356 to Lincoln H. Charlot, Jr.

Referring to FIGS. 1, 3, 4A, 4B and 4C, the first component 10 includes a member 24 that contains three fragile elongated glass vials 20 that fracture when at least a predetermined pressure is applied thereto. Each vial 20 contains a detrimental substance 22 that would damage the protected article 18 if the vial were to be fractured while the theft-deterrent device was attached to the article 18. The detrimental substance 22 preferably is a fluid colored dye or permanent ink.

The first component 10 includes a plastic vial-containing member 24 and a plastic cover 38. The member 24 is ultrasonically welded to the cover 38 at the circumferential edge of the member 24.

The member 24 and the cover 38 define a head space 25 in which the pinhead 40 is anchored. The head space 25 also enables limited axial movement of the pinhead 40. The pin 14 passes through a hole 41 in the member 24.

The member 24 further defines three chambers 26 for containing the three vials 20, and three guide channels 27 that respectively contain three stainless steel balls 29 between the pinhead 40 and the three vials 20.

The balls 29 exert little or no pressure between the vials 20 and the pinhead 40 while the attached pin 14 and clutch 16 are in a relaxed state, which occurs when no force is being applied to separate the two components 10, 12.

The guide channels 27 are contoured for enabling the pinhead 40 to force the balls 29 to move and apply more than said predetermined pressure against the vials 20 in response to the pinhead being moved in response to application to the two components 10, 12 of at least a predetermined threshold separation force, such as approximately 40 pounds (10 newtons), that is nevertheless less than that required to overcome the predetermined retaining force, to thereby fracture at least one of the vials 20 to release the substance 22 contained therein before the components 10, 12 are separated by prying or pulling the components apart. The predetermined threshold separation force must be well above both normal handling forces for the theft-deterrent device and the separation force that would be applied in attempting to separate the two components 10, 12 by using one's bare hands; and but yet, the predetermined threshold separation force must be easily attained by attempting to pry the two components 10, 12 apart with a screwdriver.

The vials 20 and the guide channels 27 are symmetrically disposed in relation to the pinhead 40 so that the pinhead 40 is equally supported by each of the three balls 29 when the pinhead 40 is being moved in response to application to the two components 10, 12 of a separation force, to thereby prevent the pinhead 40 from slipping around one of the balls 29. To further prevent any such slippage the first component 10 is so structured as not to flex when an attempt is made to pry the first component 10 from the second component 12 while the two components are locked together.

Flexible nylon cradles 34 shield the vials 20 from contact with the balls 29 during said relaxes state, but yield to enable the balls 29 to contact the vials 20 when the balls 29 are moved in response to the pinhead 40 being moved in response to application to the two components 10, 12 of at least the predetermined threshold separation force. The purpose of such separation in the relaxed state is to assure that no ball 29 contacts any vial 20 during the ultrasonic welding stage of manufacture. If such contact were allowed during the welding stage, the vials 20 would fracture due vibrating contact with the balls 20, since the ultrasonic welding causes the balls 29 to vibrate.

The cradles 34 also serve as shock absorbers for the vials 20 in order to prevent the vials 20 from being broken during normal handling of the theft-deterrent device.

Figure 4B:
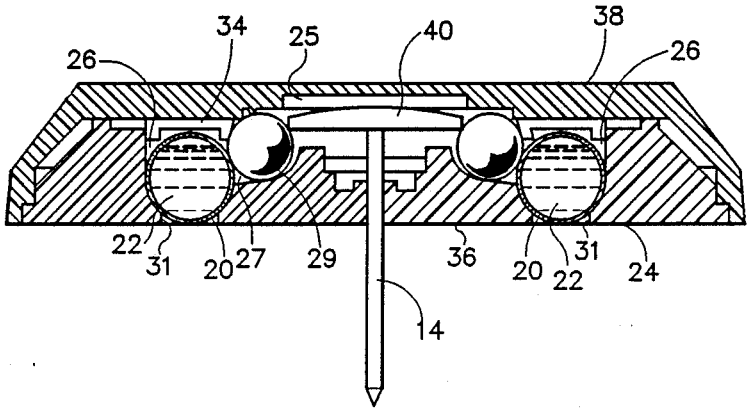

When forced separation of the two components 10, 12 is attempted, the pin 14 is forced to move axially within the vial-containing member 24 and the pinhead 40 contacts the three balls 29. The sequence of events that occur when the pin 14 starts moving from the point at which the pinhead 40 touches the cover 38 is illustrated in FIGS. 4A, 4B and 4C. The pinhead 40 touches the balls 29. The pressure point on the balls 29 at which the pinhead 40 initially contacts the balls 29, as shown in FIG. 4A, is at a point approximately one-fourth the lateral diameter of each ball 29. The force applied to the balls 29 by movement of the pinhead 40 is translated to two parts, an axial component parallel to the axial movement of the pinhead 40 and a lateral component normal to the axial movement of the pinhead 40. The balls 29 are restrained by the guide channels 27 to move laterally as the pin 14 moves axially; and the balls 29 initially contact the flexible nylon cradles 34, as shown in FIG. 4A. The cradles 34 offer only light resistance to the lateral movement of the balls 29 and are flexed aside to enable the balls 29 to continue to travel laterally until the balls 29 touch the vials 20, as shown in FIG. 4B. Further movement of the balls 29 forces the vials 20 against the walls of the chambers 26. Still further movement of the balls 29 drives the balls 29 into the surfaces of the vials 20 and exerts increasing pressure on the vials 20 until one or more of the three vials 20 fractures and releases the detrimental substance 22 contained therein, as shown in FIG. 4C. At this point the lateral pressure on the other vials 20 by the balls 25 is relaxed, thereby allowing the pinhead 40 to slip around the the balls 29, whereby the other vials will probably not rupture. Direct pull tests conducted when the axial orientation of the pin 14 is maintained within the vial-containing member 24 after the first vial 20 has ruptured shows the other vials 20 will probably also rupture. But when attempts were made to separate the two components 10, 12 with a screwdriver, the uneven lateral pressure on the pinhead which occurs when the first vial 20 fractures is sufficient to deform the vial-containing member 24 at the pinhole 41, thereby allowing the pinhead 40 to slip around the other two balls 29, thus leaving the other two vials 20 in tact.

The openings 31 to the chambers 26 in the exposed surface 36 of the member 24 are smaller than the vials 20 so as to recess the vials 20 from the exposed surface 36 and thereby prevent the vials 20 from being fractured during normal handling.

The second component 12 also is so structured as not to flex when an attempt is made to pry the first component 10 from the second component 12 while the two components are locked together, thereby concentrating separation forces resulting from said prying to be applied to forcing movement of the pinhead 40 within the member 24 of the first component 10.

Referring to FIGS. 5 and 6, the second component 12 includes a plastic cover 58 and a plastic barrel 60. The barrel 60 includes a central chamber 62 that holds the housing of the clutch 16. In order to make the second component 12 rigid so that it does not flex, the concealed surface 64 of the cover 12 includes a plurality of circular stiffening ribs 66; and the barrel 60 includes a plurality of supporting struts 68 extending radially between the central chamber 62 and the outer wall 70 of the barrel 60.

The second component 12 also includes deflection plates 72 made of two-percent-carbon hardened spring steel, which line the central chamber 62 around the clutch 16 for deflecting the bit of a drill that one might use in an attempt to penetrate the housing of the clutch 16, and thereby shield the housing of the clutch 16 from a drilling tool.

The barrel 60 is ultrasonically welded to the cover 58 at the circumferential edge of the cover 58 and at the upper edge of the central chamber 62.

I claim:

1. A device for deterring theft of a protected article, comprising means for attaching the device to the article, with said attaching means being embodied in two components that are adapted to be locked together on opposite sides of a portion of said article to prevent unauthorized removal of the device from the article, wherein the attaching means include a pin having a head that is anchored within one component and a clutch contained in the other component for grasping the pin to provide a predetermined retaining force for resisting separation of the components by prying or pulling the components apart;

wherein said one component includes at least one fragile elongated vial that fractures when at least a predetermined pressure is applied thereto, with said vial containing a detrimental substance that would damage the article if the vial were to be fractured while the device was attached to the article; and wherein said one component defines a head space for enabling limited axial movement of the pinhead, and a guide channel for containing a movable object between the pinhead and the vial; and a movable object disposed in said guide channel, with said movable object exerting little or no pressure between the vial and the pinhead while the attaching means is in a relaxed state, which occurs when no force is being applied to separate the two components;

wherein the guide channel is contoured for enabling the pinhead to force the movable object to move and apply more than said predetermined pressure against the vial in response to the pinhead being moved in response to application to the two components of at least a predetermined threshold separation force that is nevertheless less than that required to overcome said predetermined retaining force, to thereby fracture the vial to release the substance contained therein before the components are separated by prying or pulling the components apart.

2. A device according to claim 1, further comprising means for shielding the vial from contact with the movable object during said relaxed state.

3. A device according to claim 2, wherein said shield means is flexible for yielding to enable the movable object to contact the vial when the movable objects is moved in response to the pinhead being moved in response to application to the two components of at least said predetermined threshold separation force.

4. A device according to claim 1, wherein said movable object is a ball.

5. A device according to claim 1, wherein said one component is so structured as not to flex when an attempt is made to pry the two components apart.

6. A device for deterring theft of a protected article, comprising means for attaching the device to the article, with said attaching means being embodied in two components that are adapted to be locked together on opposite sides of a portion of said article to prevent unauthorized removal of the device from the article, wherein the attaching means include a pin having a head that is anchored within one component and a clutch contained in the other component for grasping the pin to provide a predetermined retaining force for resisting separation of the components by prying or pulling the components apart;

wherein said one component includes a plurality of fragile elongated vials that fracture when at least a predetermined pressure is applied thereto, with each said vial containing a detrimental substance that would damage the article if the vial were to be fractured while the device was attached to the article; and wherein said one component defines a head space for enabling limited axial movement of the pinhead, and a number of guide channels corresponding to the number of vials for containing a corresponding number movable objects between the pinhead and the respective vials; and said corresponding number of movable objects respectively disposed in said guide channels, with each said movable object exerting little or no pressure between the respective vial and the pinhead while the attaching means is in a relaxed state, which occurs when no force is being applied to separate the two components;

wherein each guide channel is contoured for enabling the pinhead to force the movable objects to move and apply more than said predetermined pressure against the vial in response to the pinhead being moved in response to application to the two components of at least a predetermined threshold separation force that is nevertheless less than that required to overcome said predetermined retaining force, to thereby fracture at least one via to release the substance contained therein before the components are separated by prying or pulling the components apart.

7. A device according to claim 6, further comprising means for shielding the vials from contact with the movable objects during said relaxed state.

8. A device according to claim 7, wherein said shielding means are flexible for yielding to enables the movable objects to contact the vials when the movable objects are moved in response to the pinhead being moved in response to application to the two components of at least said predetermined threshold separation force.

9. A device according to claim 6, wherein said movable objects are balls.

10. A device according to claim 6, wherein said one component is so structured as not to flex when an attempt is made to pry the two components apart.

11. A device according to claim 6, wherein said number is three.

12. A device according to claim 6, wherein said vials and said guide channels are are symmetrically disposed in relation to said pinhead so that the pinhead is equally supported by each of the movable objects when the pinhead is being moved in response to application to the two components of a separation force, to thereby prevent the pinhead from slipping around one of said movable objects.

13. A device according to claim 12, wherein said number is three.

* * * * *